United States Patent [19]

Kasahara

[11] Patent Number: 4,672,343

[45] Date of Patent: Jun. 9, 1987

[54] CIRCUIT PROTECTOR

[75] Inventor: Yasuo Kasahara, Tokyo, Japan

[73] Assignee: Nobuko Takei, Tokyo, Japan

[21] Appl. No.: 814,880

[22] Filed: Dec. 30, 1985

[51] Int. Cl.[4] ..... H01H 9/20

[52] U.S. Cl. ..... 335/170; 335/234; 335/179; 335/183

[58] Field of Search ..... 335/170, 174, 234, 38, 335/78, 179, 182, 183

[56] References Cited

U.S. PATENT DOCUMENTS

| | | | |
|---|---|---|---|
| 3,514,674 | 5/1970 | Toshio et al. | 335/234 |
| 4,251,789 | 2/1981 | Russell et al. | 335/174 |
| 4,467,304 | 8/1984 | Reisem | 335/234 |

FOREIGN PATENT DOCUMENTS

| | | | |
|---|---|---|---|
| 1009899 | 11/1965 | United Kingdom | 335/174 |

*Primary Examiner*—Harold Broome
*Assistant Examiner*—Lincoln D. Donovan
*Attorney, Agent, or Firm*—Stevens, Davis, Miller & Mosher

[57] ABSTRACT

A circuit protector for protecting a circuit from an overcurrent including a U-shaped main yoke, a main permanent magnet arranged between legs of the U-shaped yoke, a main coil wound around the main yoke, a movable member made of magnetic material and arranged at an open end of the U-shaped yoke, a magnetic device for generating a magnetic force for moving the movable member in a direction away from the yoke, a movable contact secured to the movable member and a fixed contact provided in opposition to the movable. The coil and the movable and fixed contacts are connected in series with a circuit to be protected across a D.C. power supply source. When an overcurrent flows through the coil, the coil generates a magnetic flux having an opposite direction to that of a magnetic flux induced by the permanent magnet, so that a magnetic force for attracting the movable member to the yoke is decreased. As a result, the movable member is separated from the yoke by the increasing magnetic force generated by the magnetic device and the movable contact is separated from the fixed contact to disconnect the circuit from the D.C. power supply source.

14 Claims, 8 Drawing Figures

N
S

CIRCUIT PROTECTOR

BACKGROUND OF THE INVENTION

Field of the Invention and Related Art Statement

The present invention relates to a circuit protector for disconnecting a circuit from a D.C. power supply source when an overcurrent flows through the circuit.

Among various types of known circuit protectors, there has been developed an oil-dash-pot type circuit protector. The circuit protector of this oil-dash-pot type comprises electromagnetic tripping-off means having a case containing a silicon oil, a coil wound around the case, an electromagnetic pole provided at one end of the case, a movable iron piece arranged outside the case movably so as to be magnetically attracted by the electromagnetic pole, and a magnetic plunger movably arranged inside the case and energized in the direction apart from the electromagnetic pole by a return spring provided in the case, wherein the plunger is moved and made into contact with the electromagnetic pole against the damping action of the return spring and silicon oil by the magnetic force induced between the pole piece and plunger when an overcurrent flows through the coil, thereby attracting the movable iron piece to the electromagnetic pole, and interrupting an electric path by separating a movable contact from a fixed contact in conjunction with the displacement of the movable iron piece.

In this circuit protector, however, the electric path is interrupted by moving the plunger against damping action of the return spring and silicon oil in generation of an overcurrent and making it into contact with the electromagnetic pole, so that it takes a relatively long time from the generation of the overcurrent to the actual interruption of the electric path. As shown by curves A and B in FIG. 1 illustrating response characteristics of the known circuit protectors of oil-dash-pot type, the response time is not only long, but also fluctuates over a wide range. Therefore, the known circuit protector has a low reliability. Further, since the magnetic resistance of the magnetic circuit for a magnetic flux induced by the coil is extremely large and the plunger has to be moved against the relatively large damping force of the return spring and silicon oil, the large flux density is required, and magnetomotive force should be made large by increasing the number of coil turns, and hence an internal impedance of the circuit protector becomes disadvantageously large and the circuit to be protected is affected to a large extent, because the circuit protector is connected in series with the circuit across the D.C. power supply source and a very large voltage drop is produced across the circuit protector.

SUMMARY OF THE INVENTION

An object of the invention is to solve the above-described various disadvantages and to provide a circuit protector which has a small internal impedance and has excellent response and reliability.

According to the invention, a circuit protector for protecting a circuit from an overcurrent comprises a yoke made of magnetic material;

a movable member made of magnetic material and arranged movably with respect to the yoke;

a permanent magnet provided in relation to said yoke in such a manner that a first magnetic flux having a first direction is induced in a closed magnetic circuit composed of said yoke and movable member;

a coil wound around the yoke for generating in said closed magnetic circuit a second magnetic flux having a second direction opposite to said first direction;

a pair of contacts connected in series with said coil, at least one of contacts being arranged movably in conjunction with movement of the movable member; and an auxiliary magnetic device for generating a magnetic force for separating the movable member from the yoke;

whereby when a current passing through the coil is lower than a predetermined value, the movable member is attracted magnetically to the yoke against an action of the auxiliary magnetic device and the contacts are brought into contact with each other, whereas when the current exceeds the predetermined value, the magnetic force for attracting the movable member to the yoke is weakened and the magnetic flux for separating the movable member from the yoke is increased, so that the movable member is separated from the yoke and the contacts are separated from each other.

DESCRIPTION OF THE PREFERRED EMBODIMENTS

Figure 2A:
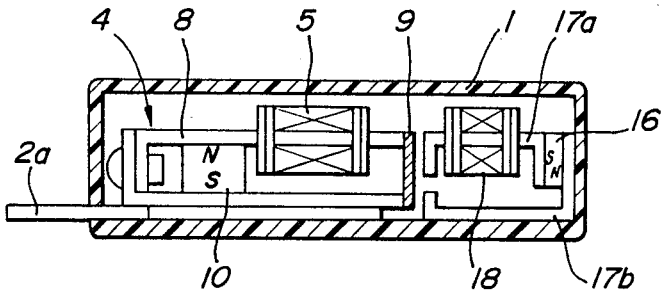
FIGS. 2A and 2B are a cross-sectional view and a plan view, respectively showing an embodiment of the circuit protector according to the invention.
Figure 2B:
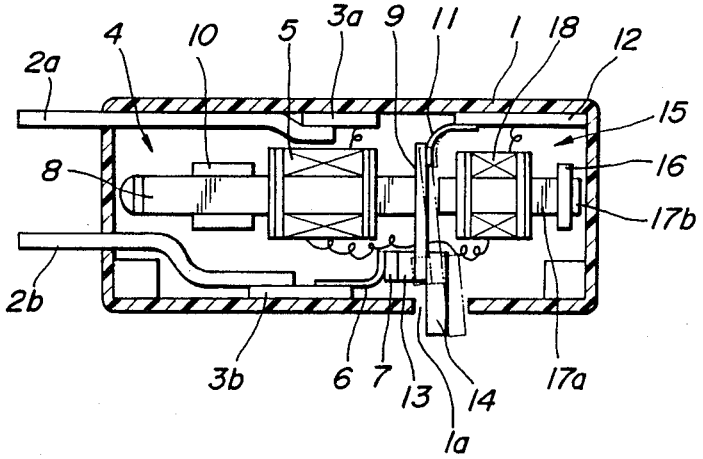

FIGS. 2A and 2B are a cross-sectional view and a plan view, respectively showing an embodiment of the circuit protector according to the invention. A case 1 is made of insulating material such as plastics and the like, and a pair of external connector terminals 2*a*, 2*b* are projected from the case 1. These external connector terminals 2*a*, 2*b* are connected to conductive members 3*a*, 3*b*, respectively in the case 1. To the conductive member 3*a* is connected one terminal of a main coil 5 wound around a main magnetic circuit 4, and to the conductive member 3*b* is connected a fixed contact 7 through a conductive leaf spring 6.

The main magnetic circuit 4 is composed of a U-shaped yoke 8, a conductive movable member 9 made of magnetic material and a main permanent magnet 10 for magnetically attracting the movable member 9 to the open end of the yoke 8. The main coil 5 is wound around one leg portion of the yoke 8. One end of the movable member 9 is fixed to a conductive member 12 through a conductive leaf spring 11 which deflects the movable member in the direction apart from the yoke 8. To the other end of the movable member 9 is secured a movable contact 13. When the movable member 9 is in the first position shown by a solid line, it is made into contact with the yoke 8 and the movable contact 13 is brought into contact with the fixed contact 7. To the other end of the movable member 9 is further secured one end of a reset button 14 made of insulating material such as plastics and the like, and the other end of the reset button 14 is projected through an opening 1*a* formed in the case 1.

On the side opposite to the yoke 8 of the movable member 9 is provided an attracting magnetic circuit 15 for moving the movable member 9 into a second position shown by a chain line and separating the movable contact 13 from the fixed contact 7, when the overcurrent flows through the circuit. The attracting magnetic circuit 15 is constructed in such a manner that to both magnetic poles of a permanent magnet 16 are connected one ends of respective yokes 17*a*, 17*b*, and the other ends of these yokes 17*a*, 17*b* are faced to the movable member 9 made of magnetic material, so that the movable member 9 may be magnetically attracted to the other ends of the yokes 17*a*, 17*b*, i.e., the second position. In this embodiment, an auxiliary coil 18 is wound around the yoke 17*a*, of the attractive magnetic circuit 15, and one and the other terminals of the auxiliary coil 18 are connected to the other terminal of the main coil 5 wound around the main magnetic circuit 4 and the conductive member 12, respectively. That is to say, the main and auxiliary coils 5 and 18 are connected in series with the connector terminals 3*a*, 3*b*. There is thus constructed an electric path passing through external connector terminal 2*a*—conductive member 3*a*—main coil 5—auxiliary coil 18—conductive member 12—leaf spring 11—movable member 9—movable contact 13—fixed contact 7—leaf spring 6—conductive member 3*b*—external connector terminal 2*b*. When the circuit is in the closed condition, the main coil 5 generates a magnetic flux in the yoke 8 in a direction opposite to that of a magnetic flux induced by the permanent magnet 10 and the auxiliary coil 18 produces a magnetic flux in the yoke 17*a* in the same direction as that of a magnetic flux induced by the permanent magnet 16. As long as the current passing through the circuit is below a rated value, the force for attracting magnetically the movable member 9 to the yoke 8 is sufficiently large and the movable member 9 is effectively maintained in the first position against the magnetic forces of the coils 5 and 18 and the permanent magnet 16 and the mechanical force of the leaf spring 11, so that the movable contact 13 is forced into contact with the fixed contact 7.

Figure 1:
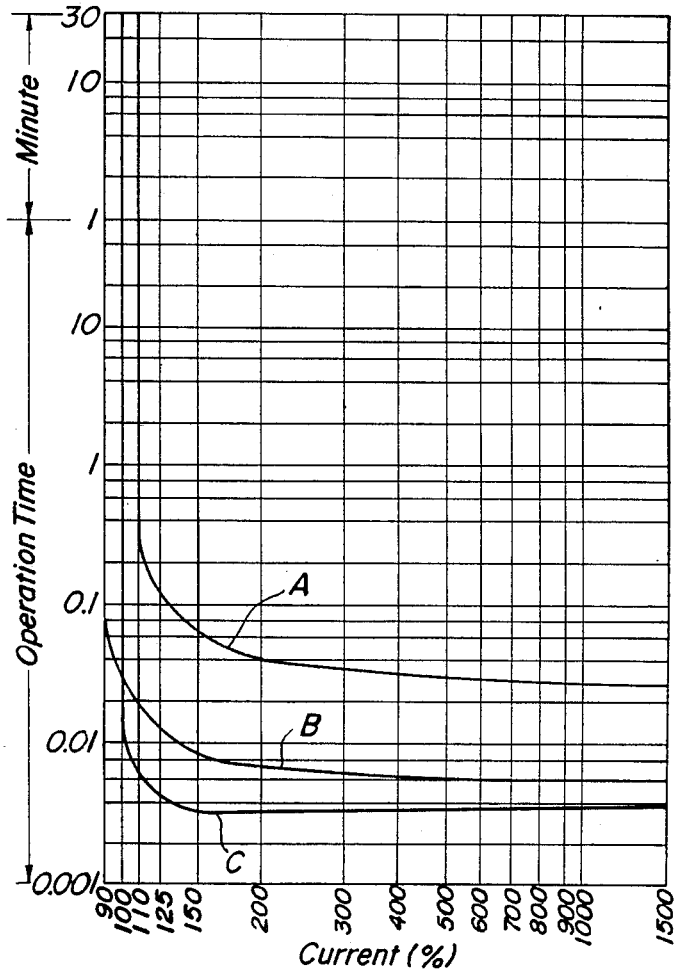
FIG. 1 is a graph showing the response characteristics of the known circuit protector and the circuit protector according to the invention.

In the above-described construction, when an overcurrent exceeding the rated value flows into the circuit, magnetomotive forces of the main coil 5 and auxiliary coil 18 are increased, and thus the magnetic force for attracting the movable member 9 toward the yoke 8 due to the permanent magnet 10 is weakened abruptly and at the same time the magnetic force induced in the attractive magnetic circuit 15 by the auxiliary coil 18 and permanent magnet 16 is increased. Since the magnetic circuit of the main coil 5 is the closed loop one comprising the yoke 8 and the movable member 9, its magnetic resistance is extremely small, and the BH characteristic of the magnetic path can easily be selected such that, even if the increase of the current passing through the coil 5 is minute, a large magnetic flux change is generated in the yoke 8, and as a result, the magnetic attractive force acting upon the movable member 9 by the permanent magnet 10 is momentarily weakened. As a result, the movable member 9 is instantaneously attracted to the yokes 17*a*, 17*b* of the magnetic circuit 15 and is driven into the second position due to the magnetic force of the attracting magnetic circuit 15 and the mechanical force of the leaf spring 11. As a result, movable contact 13 is instantaneously separated from the fixed contact 7 as shown by a curve C in FIG. 1. In this manner, the circuit is interrupted instantaneously and stably. When the electric path is thus interrupted, no more electromotive force is generated in the coil 5 and the attractive auxiliary coil 18, but the movable member 9 is effectively held into the second position by the mechanical force of the leaf spring 11 and the magnetic attractive force of the auxiliary permanent magnet 16. Further, under the interrupted condition of the electric path where the movable member 9 is in the second position, when the movable member 9 is manually moved to the first position through the reset button 14 against the forces of the leaf spring 11 and permanent magnet 16, the movable member 9 is reset and the electric path is closed again.

Figure 3:
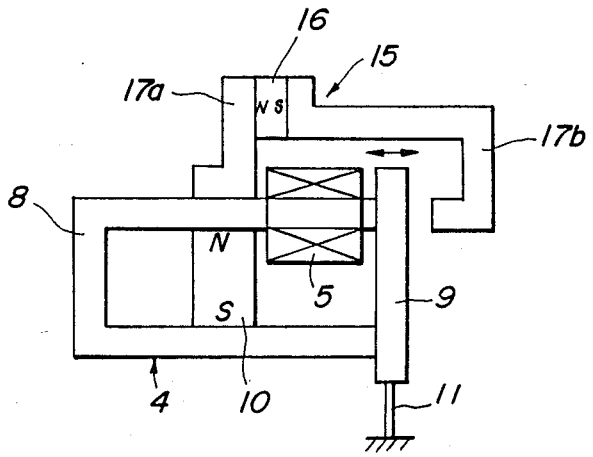
FIG. 3 shows another embodiment of the circuit protector according to the invention.
Figures 4A, 4B, 4C, 4D:
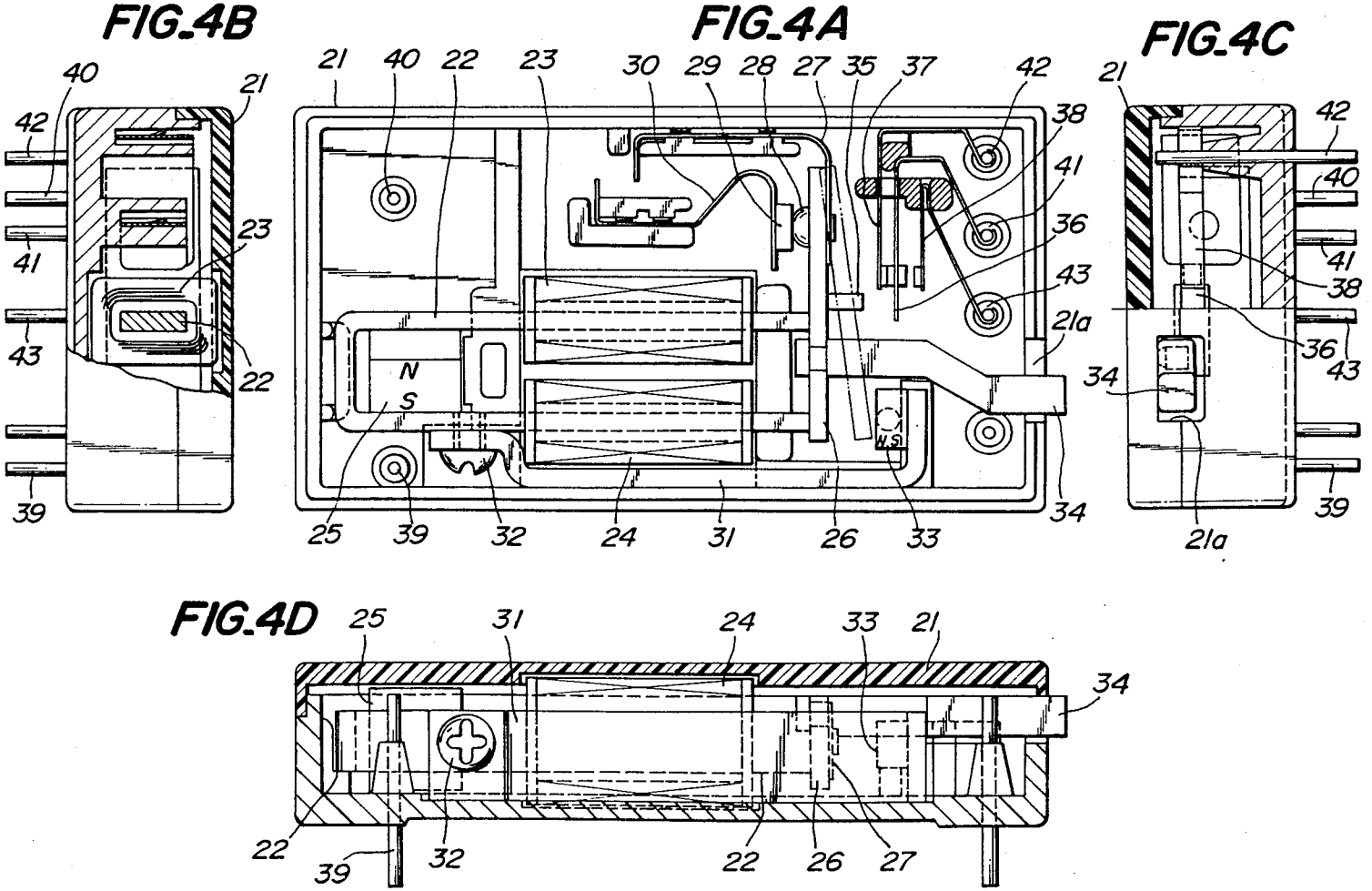
FIGS. 4A to 4D illustrate still another embodiment of the circuit protector according to the invention.

The invention is not limited to the above embodiment but can be modified or changed in various ways. For example, the permanent magnet 10 for constructing the main magnetic circuit 4 is not necessarily required to be arranged directly between the opposite sides of the U-shaped yoke 8, but a gap can be provided between either one or both magnetic poles and one or both sides of the opposed yoke 8, a magnetic member or magnetic members having a suitable thickness may be inserted into the gap or gaps such that the magnetic attractive force acting upon the movable member 9 is adjusted. Further, as shown in FIG. 3, it is also possible to construct the attracting magnetic circuit 15 only by the auxiliary permanent magnet 16 and yokes 17*a* and 17*b*. In this embodiment, when the overcurrent flows through the main coil 5, the magnetic flux induced in the main yoke 8 by the main permanent magnet 10 is decreased abruptly and at the same time the movable member 9 is attracted to the yoke 17*b* due to the increasing magnetic flux induced between yoke 17*b* and movable member 9 and the mechanical force of the spring 11. In this manner, it is not necessary to use any other auxiliary coil, so that it is possible to make the internal impedance much smaller, and the main magnetic circuit 4 except the movable member 9 and the attractive magnetic circuit 15 are integrally molded so as to facilitate manufacture .

In the embodiment shown in FIG. 2, the movable member 9 and the leaf spring 11 are assembled in the current path, but they need not necessarily be assembled in the current path. Instead, auxiliary coil 18 may be directly connected to the movable contact 13. In this case, the movable member 9 may be formed with a non-conductive magnetic member.

Moreover, the main coil 5 and auxiliary coil 18 are not necessarily connected in series but can alternatively be connected in parallel. There is further such a construction that the movable member 9 and the movable contact 13 are coupled through a suitable interlocking mechanism, and the movable contact 13 is joined with or separated from the fixed contact 7 by the movable member 9 through this interlocking mechanism.

Furthermore, the resetting operation of the movable member may be carried out automatically with the aid of an electromagnetic valve.

FIGS. 4A to 4D illustrate another embodiment of the circuit protector according to the invention which is similar to the principal construction shown in FIG. 3. The circuit protector comprises a case 21 made of non-magnetic and non-conductive material, a U-shaped main yoke 22, a pair of main coils 23 and 24 wound around respective leg portions of the main yoke 22, a main permanent magnet 25 provided between the leg portions of the main yoke 22, and a movable member 26 made of magnetic material. The movable member is coupled with the case 21 by means of a conductive leaf spring 27. A movable contact 28 is provided on the movable member 26 and a fixed contact 29 is secured to the case 21 via a conductive leaf spring 30. In the present embodiment, one end of an auxiliary yoke 31 is secured to the leg portion of the main yoke 22 by a screw 32 and the other end of the auxiliary yoke 31 is extended to a position which faces with the movable member 26. To the other end of the auxiliary yoke 31 is secured an auxiliary permanent magnet 33. To the movable member 26 is further secured one end of a reset lever 34 whose other end is extended from the case 21 through an opening 21*a*. Further, a projection 35 is secured to the movable member 26 and a movable contact 36 of an auxiliary switch is swung by the projection between fixed contacts 37 and 38 of the auxiliary switch.

One connector pin 39 is connected to one end of each of main coils 23 and 24 and other ends of these main coils are commonly connected to the conductive member 30. Further, the leaf spring 27 is connected to the other connector pin 40 via a wire conductor not shown. Therefore, the electric path is composed of connector pin 39—first and second main coils 23 and 24—conductive member 30—fixed contact 29—movable contact 28—conductive leaf spring 27—connector pin 40. Further, the contacts 36, 37 and 38 of the auxiliary switch are connected to connector pins 41, 42 and 43, respectively.

The main coils 23 and 24 are wound in such a manner that magnetic fluxes induced by the coils in the main yoke 22 are made opposite to a magnetic flux generated by the main permanent magnet 25. Further, the auxiliary permanent magnet 33 is so polarized that magnetic fluxes induced by the auxiliary permanent magnet in the yoke 31 are made opposite to those generated by the coils 23, 24. In the steady state in which the current passing through the circuit is below a predetermined value, the magnetic force attracting the movable member 26 toward the yoke 22 is large and thus the movable member 26 remains in contact with the yoke 22 due to this attracting force and the contacts 28 and 29 are also in contact with each other. Further, the movable contact 36 of the auxiliary switch is brought into contact with the fixed contact 37. When the current is increased, the above-described attracting force due to the permanent magnet 25 is decreased and when the current becomes larger than the predetermined value, the attracting force becomes smaller than an abruptly increasing attracting force induced between the auxiliary permanent magnet 33 and the movable member 26 and the movable member is separated from the yoke 22 and is attracted to the auxiliary permanent magnet 33. Then the contacts 28 and 29 are separated from each other and the movable contact 36 of the auxiliary switch is brought into contact with the contact 38. In this manner, the electric path can be cut-off very rapidly and the circuit can be effectively protected from overcurrent . It should be noted that the auxiliary switch may be used for driving a pilot lamp or alarm device.

In the circuit protector according to the invention, the interruption period is about 500 $\mu$s to 1.2 mS, whereas the interruption period of heretofore known circuit protectors is at least about 2 mS. Further, according to the invention, since the internal impedance can be very low, the voltage drop across the circuit protector is very small. For instance, in the circuit protector according to the invention the voltage drop is about 2.1 V at a current of 0.04 A, whereas in known magnetic type circuit protectors the voltage drop is about 20 V at a current of 0.05 A. Therefore, the circuit protector according to the invention is particularly suitable for circuit protection in printed circuit boards widely used in systems for office automation, factory automation, home automation and laboratory automation.

In the circuit protector according to the invention, it is essential to provide the main magnetic circuit coupled with the main permanent magnet, the main coil wound around the main magnetic circuit and the auxiliary magnetic circuit for generating the magnetic force for separating the movable member from the main magnetic circuit. If the auxiliary magnetic circuit is omitted and the movable member is constantly biased by a spring or a permanent magnet in a direction away from the main magnetic circuit, the movable member could not be permanently separated from the main magnetic circuit when the current passing through the main coil is increased abruptly to a large value as in the case of a short-circuit. This is because, when the current increases abruptly, the magnetic flux passing through the main magnetic circuit is also decreases abruptly due to the magnetic flux generated by the main coil, and therefore the magnetic force for retaining the movable member to the main magnetic circuit might instantaneously decrease to a small value. However, since the main magnetic circuit is magnetized in the opposite direction by the magnetic flux generated by the main coil, said magnetic force is abruptly increased, so that the movable member could not be separated from the main magnetic circuit. According to the invention, when the current passing through the main coil is abruptly increased, the magnetic force generated by the auxiliary magnetic circuit is increased also abruptly, so that the movable member can be positively separated from the main magnetic circuit. In this case, the spring and auxiliary permanent magnet serve effectively to accelerate the movement of the movable member away from the main magnetic circuit as well as to retain the movable member in the position separated from the main magnetic circuit.

As stated above, according to the invention, the main coil is wound around the main yoke constructing the closed loop magnetic circuit together with the movable member. It is possible to make the magnetic resistance of the magnetic circuit extremely small, and to efficiently utilize the BH characteristics of the magnetic material of the yoke and the movable member. Therefore, even if the number of coil turns is small, a large magnetic flux can be generated when the current passing through the coil is increased slightly beyond the rated value, and as a result, the current path can be uniformly and instantaneously interrupted, thereby quick response and high reliability can be obtained. Further, since the internal impedance of the protector can be made small, the circuit to be protected is not affected by the protector.

What is claimed is:

1. A circuit protector for protecting a circuit from an overcurrent, comprising:

a U-shaped yoke made of magnetic material;

a movable member made of magnetic material and arranged movably with respect to the yoke, said movable member being attracted to an open end of the yoke;

a permanent magnet disposed relative to said yoke such that a first magnetic flux having a first direction is induced in a closed magnetic circuit composed of said yoke and said movable member;

a coil wound around one leg portion of the yoke for generating in said closed magnetic circuit a second magnetic flux having a second direction opposite to said first direction;

a pair of contacts connected in series with said coil, at least one of said contacts being arranged to move in conjunction with movement of the movable member; and an auxiliary magnetic device for generating a magnetic force for separating the movable member from the yoke;

whereby when a current passing through the coil is lower than a predetermined value, the movable member is attracted magnetically to the yoke against an action of the auxiliary magnetic device and the contacts are brought into contact with each other, whereas when said current exceeds said predetermined value, a magnetic force attracting the movable member to the yoke decreases and the magnetic force for separating the movable member from the yoke increases, so that the movable member is separated from the yoke and the contacts are separated from each other.

2. A circuit protector for protecting a circuit from an overcurrent, comprising:

a yoke made of magnetic material;

a movable member made of magnetic material and arranged movably with respect to the yoke;

a permanent magnet disposed relative to said yoke such that a first magnetic flux having a first direction is induced in a closed magnetic circuit composed of said yoke and said movable member;

a coil wound around the yoke for generating in said closed magnetic circuit a second magnetic flux having a second direction opposite to said first direction;

a pair of contacts connected in series with said coil, at least one of said contacts being arranged to move in conjunction with movement of the movable member; and an auxiliary magnetic device for generating a magnetic force for separating the movable member from the yoke;

whereby when a current passing through the coil is lower than a predetermined value, the movable member is attracted magnetically to the yoke against an action of the auxiliary magnetic device and the contacts are brought into contact with each other, whereas when said current exceeds said predetermined value, a magnetic force attracting the movable member to the yoke decreases and the magnetic force for separating the movable member from the yoke increases, so that the movable member is separated from the yoke and the contacts are separated from each other, wherein said yoke comprises a Ushaped yoke, the coil comprises a pair of coil portions each wound around respective leg portions of the U-shaped yoke, and the movable member is attracted to an open end of the U-shaped yoke.

3. A circuit protector for protecting a circuit from an overcurrent, comprising:

a yoke made of magnetic material;

a movable member made of magnetic material and arranged movably with respect to the yoke;

a permanent magnet disposed relative to said yoke such that a first magnetic flux having a first direction is induced in a closed magnetic circuit composed of said yoke and said movable member;

a coil wound around the yoke for generating in said closed magnetic circuit a second magnetic flux having a second direction opposite to said first direction;

a pair of contacts connected in series with said coil, at least one of said contacts being arranged to move in conjunction with movement of the movable member; and an auxiliary magnetic device for generating a magnetic force for separating the movable member from the yoke;

whereby when a current passing through the coil is lower than a predetermined value, the movable member is attracted magnetically to the yoke against an action of the auxiliary magnetic device and the contacts are brought into contact with each other, whereas when said current exceeds said predetermined value, a magnetic force attracting the movable member to the yoke decreases and the magnetic force for separating the movable member from the yoke increases, so that the movable member is separated from the yoke and the contacts are separated from each other, wherein the auxiliary magnetic device comprises an auxiliary magnetic yoke having a portion arranged in opposition to the movable member.

4. A circuit protector according to claim 3, wherein said auxiliary magnetic device further comprises an auxiliary permanent magnet coupled with the auxiliary yoke.

5. A circuit protector according to claim 4, wherein said auxiliary magnetic device further comprises an auxiliary coil wound around the auxiliary yoke for generating a magnetic flux having the same direction as that of a magnetic flux induced by the auxiliary permanent magnet.

6. A circuit protector according to claim 5, wherein the auxiliary coil is connected in series with the coil wound around the yoke.

7. A circuit protector according to claim 3, wherein one end of said auxiliary yoke is coupled with the yoke and the other end of the auxiliary yoke is opposed to the movable member.

8. A circuit protector according to claim 7, wherein said auxiliary magnetic device further comprises an auxiliary permanent magnet coupled with the auxiliary yoke.

9. A circuit protector according to claim 8, wherein said auxiliary permanent magnet is polarized in such a sense that a magnetic flux generated by the auxiliary permanent magnet is opposite to a magnetic flux generated in the auxiliary yoke by the coil.

10. A circuit protector according to claim 9, wherein said auxiliary permanent magnet is provided at the end of the auxiliary yoke in opposition to the movable member.

11. A circuit protector according to claim 1, further comprising means for manually resetting the movable member.

12. A circuit protector according to claim 1, further comprising an auxiliary switch having a movable contact driven by the movable member.

13. A circuit protector according to claim 3, further comprising means for manually resetting the movable member.

14. A circuit protector according to claim 3, further comprising an auxiliary switch having a movable contact driven by the movable member.

* * * * *